US009840941B2

(12) United States Patent
Kress et al.

(10) Patent No.: US 9,840,941 B2
(45) Date of Patent: Dec. 12, 2017

(54) INTERNAL LEVER FOR A SWITCHABLE CAM FOLLOWER FOR A VALVE TRAIN OF AN INTERNAL COMBUSTION ENGINE AND METHOD FOR PRODUCING AN INTERNAL LEVER

(71) Applicant: Schaeffler Technologies AG & Co. KG, Herzogenaurach (DE)

(72) Inventors: Michael Kress, Lonnerstadt (DE); Kilian Dummer, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/403,586

(22) Filed: Jan. 11, 2017

(65) Prior Publication Data

US 2017/0204748 A1 Jul. 20, 2017

(30) Foreign Application Priority Data

Jan. 19, 2016 (DE) ..... 10 2016 200 621

(51) Int. Cl.
*F01L 1/18* (2006.01)

(52) U.S. Cl.
CPC ..... *F01L 1/181* (2013.01); *F01L 2103/00* (2013.01); *F01L 2105/02* (2013.01)

(58) Field of Classification Search
CPC ..... F01L 1/18; F01L 1/185; F01L 13/0005; F01L 13/0036; F01L 2101/00; F01L 2105/00; F01L 2103/00; F01L 2820/01; F01L 2001/186; B21K 1/205; Y10T 29/49295; Y10T 74/2107; Y10T 74/20882
USPC ..... 74/559, 569; 123/90.44, 90.39, 90.16, 123/90.41, 90.43, 198 F, 90.45; 29/888.2
See application file for complete search history.

(56) References Cited

U.S. PATENT DOCUMENTS

| | | | |
|---|---|---|---|
| 7,240,652 | B2 | 7/2007 | Roerig et al. |
| 7,302,924 | B2 | 12/2007 | Roerig et al. |
| 8,006,662 | B2 | 8/2011 | Roerig |
| 2013/0199480 | A1 | 8/2013 | Manther et al. |

(Continued)

FOREIGN PATENT DOCUMENTS

| | | |
|---|---|---|
| DE | 10310968 | 9/2004 |
| DE | 102005037051 | 2/2007 |

(Continued)

OTHER PUBLICATIONS

Machine translations of DE 102013210390 (Dec. 11, 2014).*

*Primary Examiner* — Mark Laurenzi
*Assistant Examiner* — Mickey France
(74) *Attorney, Agent, or Firm* — Volpe and Koenig, P.C.

(57) ABSTRACT

An internal lever for a switchable cam follower for a valve train of an internal combustion engine with two opposite side walls (1, 2), between which at least one cam roller (9) can be arranged for following a cam stroke motion and aligned opposing openings (3, 4) on a support-side lever end area for holding a shaft (7) for the pivoting support on an external lever (8) of the cam follower encompassing the internal lever at least in some sections. The side walls (1, 2) are made from sheet metal and, arranged in the area of the openings (3, 4) spaced apart from each other, define a space for the arrangement of the cam roller (9) and are connected to each other by at least one stiffening element (5). A method for producing an internal lever is also provided.

8 Claims, 4 Drawing Sheets

(56) References Cited

U.S. PATENT DOCUMENTS

| | | | | |
|---|---|---|---|---|
| 2014/0083380 | A1* | 3/2014 | Hiramatsu | F01L 1/185 123/90.15 |
| 2015/0128890 | A1* | 5/2015 | Cecur | F01L 1/185 123/90.16 |

FOREIGN PATENT DOCUMENTS

| | | |
|---|---|---|
| DE | 102005037052 | 2/2007 |
| DE | 102007036679 | 2/2009 |
| DE | 102013210390 | 12/2014 |

* cited by examiner

INTERNAL LEVER FOR A SWITCHABLE CAM FOLLOWER FOR A VALVE TRAIN OF AN INTERNAL COMBUSTION ENGINE AND METHOD FOR PRODUCING AN INTERNAL LEVER

INCORPORATION BY REFERENCE

The following documents are incorporated herein by reference as if fully set forth: German Patent Application No. 102016200621.5, filed Jan. 19, 2016.

FIELD OF THE INVENTION

The invention relates to an internal lever for a switchable cam follower for a valve train of an internal combustion engine and a method for producing an internal lever.

Such an internal lever is known from DE 10 2007 036 679 A1. In that publication, an internal lever made from steel sheet with thin-walled side walls is described. These are provided greatly angled toward each other on one end section for producing the necessary stiffness and are continued in the lever longitudinal direction toward the end as perpendicular longitudinal bars that contact each other and form aligned openings for a shaft for the pivoting connection to an external lever. Such a design is complicated, requires a lot of installation space, and also requires a high-mass connection of the internal lever to the shaft with increased mass moment of inertia and correspondingly degraded dynamic response.

SUMMARY

The invention is therefore based on simplifying and economically forming an internal lever of the type specified above and a method for producing an internal lever.

The is achieved with an internal lever for a switchable cam follower with one or more features of the invention as well as a method for producing such a switchable cam follower. Other advantageous constructions are given in the description, claims, and drawings.

An internal lever for a switchable cam follower for a valve train of an internal combustion engine is provided having two opposing side walls made from sheet metal that have, on a support-side lever end area, aligned opposing openings for receiving a shaft for the pivoting support on an external lever of the cam follower. Here, the side walls are arranged in the area of the openings spaced apart from each other such that they form a space for holding a cam roller arranged between the side walls. Because the cam roller can be arranged at least partially in said space, the distance between this and the shaft can be reduced, which can significantly reduce the installation space. In addition, this arrangement enables a simple attachment of the internal lever that can be variably adapted to the installation relationships on the shaft for simultaneously reduced mass of the internal lever in a sheet-metal construction. For guaranteeing the required stiffness of the construction in sheet metal, the side walls can be connected to each other on the support-side lever end area by at least one stiffening element.

It is advantageous if each stiffening element is produced connected integrally to the side walls. Here, it is preferably a two-part construction, wherein both parts are produced, on one hand, integrally with the side walls and, on the other hand, are connected rigidly to each other.

For constructing the stiffening element, two links produced integrally with the side walls are provided that extend in a bow shape on the side walls accordingly toward each other and are welded to each other at their free ends. Alternatively, the stiffening element can also have an integral construction starting from one side wall connected to the other side wall. For producing the connection of the stiffening element to one side wall or to both side walls, folds or crimps are also possible.

One especially installation space saving construction of the internal lever is achieved when the open distance between the shaft and cam roller is less than or equal to twice the wall thickness of the side walls.

The stiffening element is advantageously arranged outside of the said space and spans this space in a bow shape for connecting the side walls.

The stiffening element is arranged outside of the said space preferably in the area of the openings parallel to the shaft and at the height of or close to this shaft.

The construction can be further optimized with respect to mass and production if the stiffening element has a width that is less than or equal to the wall thickness of the side walls in the area of the openings. Here, the stiffening element preferably has a square cross-sectional profile with an edge length that corresponds to the wall thickness of the side walls or approximately corresponds to this thickness.

It is also conceivable that the stiffening element has a width that is less than or equal to one-third the distance of the side walls in the area of the openings.

The side walls and the stiffening element can be produced from sheet metal in an especially simple way by stamping and bending.

The side walls can be connected in a simple way on the lever end area facing away from the support-side lever end area by a cross web made from sheet metal. Preferably the side walls and cross web form, in top view, a U-shaped profile that has an open construction on the support-side lever end area. The internal lever can be produced in an especially simple way, in particular, by stamping and bending.

In one preferred construction of the invention, the internal lever is constructed as a so-called secondary lever on which, in the decoupled state with the external lever for the transmission of a cam stroke motion by the cam roller, a lost stroke motion relative to the external lever can be performed.

The objective according to the invention is also achieved by a method for producing an internal lever for a switchable cam follower for a valve train of an internal combustion engine. Here, two opposite side walls, between which a cam roller can be arranged for following a cam stroke motion, is provided on a support-side lever end area with aligned opposite openings for attaching a shaft to the pivoting support on an external lever of the cam follower. According to the invention it is provided to produce the side walls made from sheet metal and to connect them to each other on the support-side lever end area by at least one stiffening element.

The stiffening element is used, in particular, for guaranteeing the stiffening necessary for production in the sheet metal and for the assembly with the external lever. It is conceivable to remove this element after production and assembly. It is also conceivable to leave the stiffening element for guaranteeing the stiffening required during operation on the internal lever.

The internal lever, especially the stiffening element, can be produced with at least one of the features described above.

BRIEF DESCRIPTION OF THE DRAWINGS

Other features of the invention are given from the following description and from the drawings, in which an embodiment of the invention is shown simplified. Shown are.

DETAILED DESCRIPTION OF THE PREFERRED EMBODIMENTS

Figure 1:
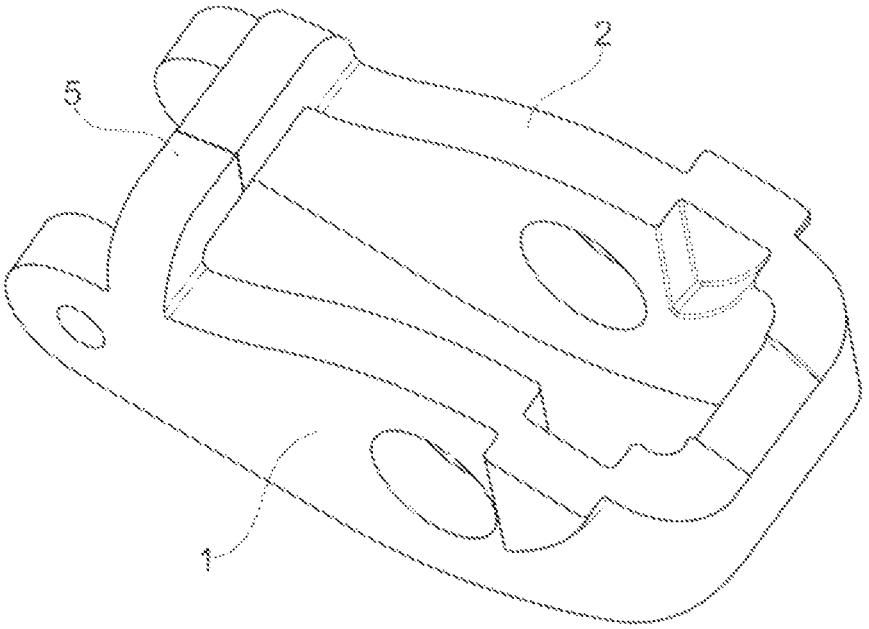
FIG. 1 a perspective diagram of an internal lever according to the invention for a cam follower of a valve train of an internal combustion engine, FIG. 2 another perspective diagram of the internal lever, FIG. 3 the internal lever in a top view, FIG. 4 a partial view of the internal lever, FIG. 5 another partial view of the internal lever, FIG. 6 another view of the internal lever, and FIG. 7 a perspective view of the internal lever arranged in a switchable cam follower.
Figure 2:
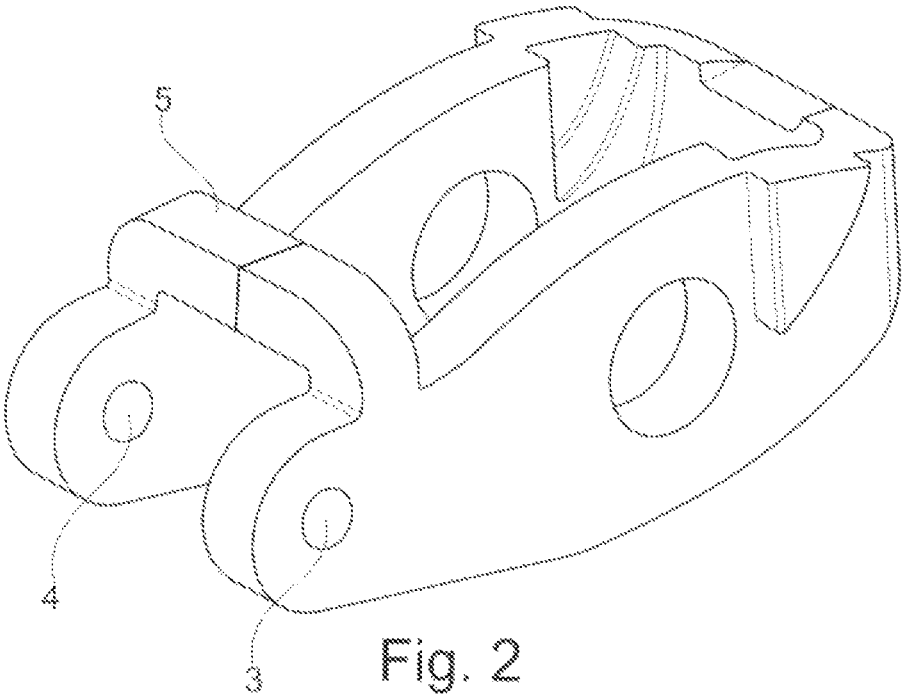
Figure 3:
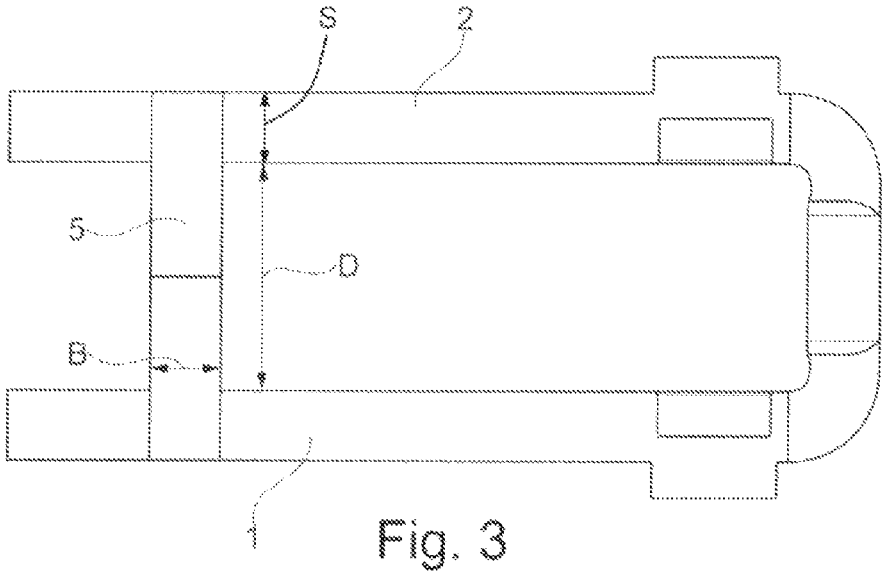

The internal lever shown as an example in FIGS. 1 to 3 for a switchable cam follower for a valve train of an internal combustion engine is produced from sheet metal by shaping. It has two parallel, spaced apart, opposing side walls 1, 2 that extend in the lever longitudinal direction. On a support-side lever end area, continuous, aligned, opposing openings 3, 4 are provided (FIG. 2) on the side walls 1, 2. These are used for holding a not-shown shaft for pivoting support on a similarly not shown external lever of the cam follower encompassing the internal lever at least in some sections. In the area of the openings 3, 4, the spaced-apart, opposing side walls 1, 2 define a space for holding a not-shown cam roller that can be arranged between the side walls 1, 2 and can be supported on these passage holes formed in a middle area located between the lever end areas (FIGS. 1 and 2). Here, the cam roller can be arranged in the said space with a small distance to the shaft that can be held in the openings 3, 4.

On its coupling-side lever end area, the internal lever can be coupled with the external lever for switching the cam follower. There, the side walls 1, 2 are connected rigidly by a cross web. The side walls 1, 2 and the cross web form, in the top view, viewed in top view, a U-shaped profile (FIG. 3) that has an open construction on the support-side lever end area in the pivoting direction and in the lever longitudinal direction.

On the support-side lever end area, the side walls 1, 2 are connected to each other by at least one stiffening element 5 that is arranged outside of the space defined by the side walls 1, 2 and is connected at its ends integrally to the edges of the side walls 1, 2. The stiffening element 5 runs perpendicular to the side walls 1, 2 and is axis-parallel to the openings 3, 4 and arranged close to these openings. On the top side of the internal lever, the so-called top section, with which this can be arranged facing the cam roller for following a cam stroke motion of a camshaft, the stiffening element 5 spans in a bow shape the space between the side walls 1, 2. In the top view, it has a rectangular shape with long, opposing longitudinal sides and narrow width B (FIG. 3). Here, the width B of the stiffening element 5 is less than or equal to the wall thickness S. It can also be less than or equal to one third the open distance D of the side walls 1, 2 in the area of the openings 3, 4.

Figure 4:
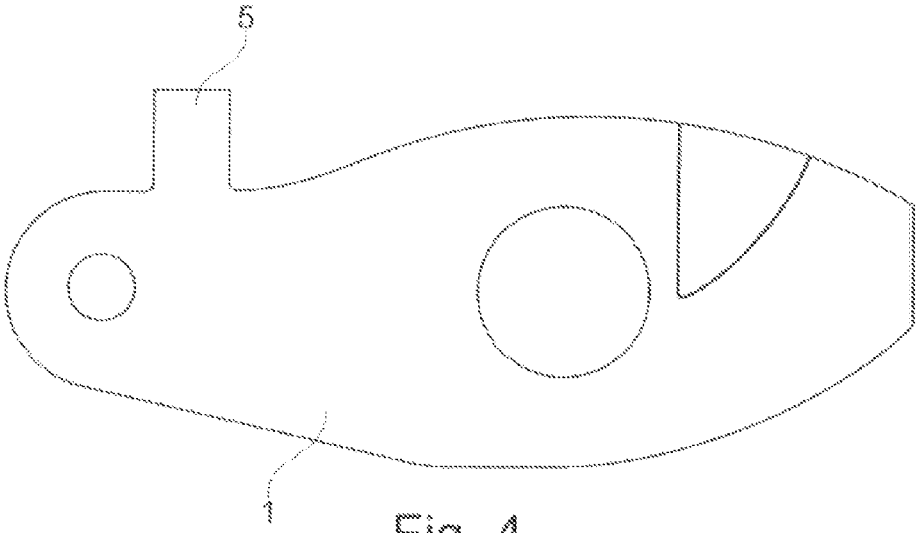
Figure 5:
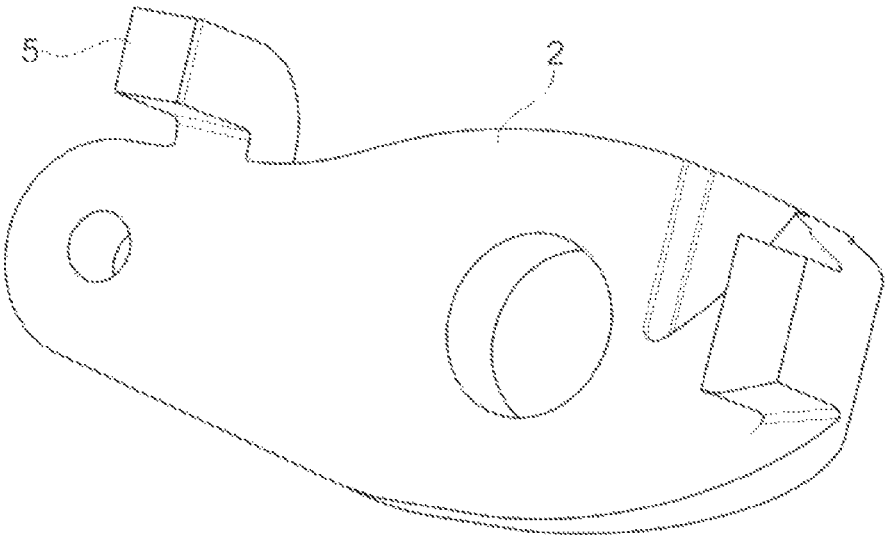
Figure 6:
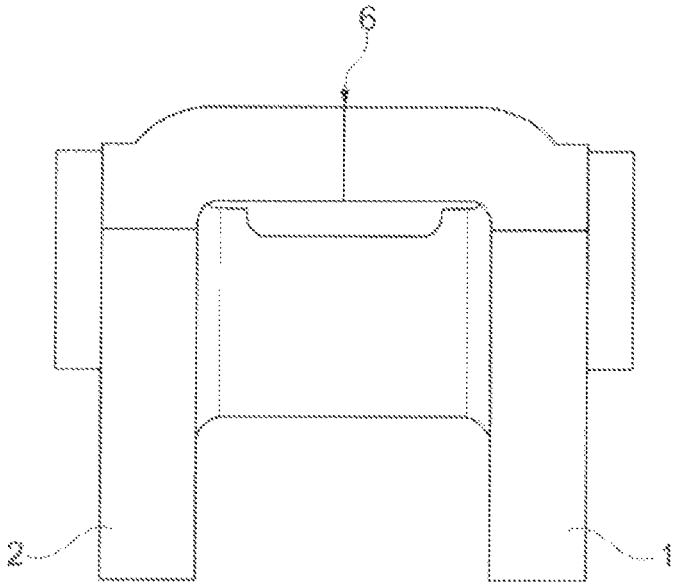

According to FIGS. 4 to 6, the stiffening element 5 is constructed in two parts. FIGS. 4 and 5 each show a side wall 1, 2 with a part of the stiffening element 5 during production. Each part is constructed correspondingly to each other on the respective material thickness side of the side walls 1, 2, here on the top side of the internal lever, as links connected integrally to each side wall 1, 2 (FIGS. 4 and 5). The links are each punched integrally with the side walls 1, 2 and project like shoulders at 90° arc correspondingly toward each other on the material thickness sides. They are oriented with their free ends in the direction of the insides of the side walls 1, 2 facing each other. The links each have a rectangular, approximately square cross-sectional profile with an edge length that corresponds approximately to the wall thickness S of the side walls 1, 2. They are connected rigidly to each other on their respective free ends by a welded joint 6 (FIG. 6). Here, the side walls 1, 2 and the respective links are each formed symmetrical to the lever longitudinal axis and are produced by stamping and bending.

Figure 7:
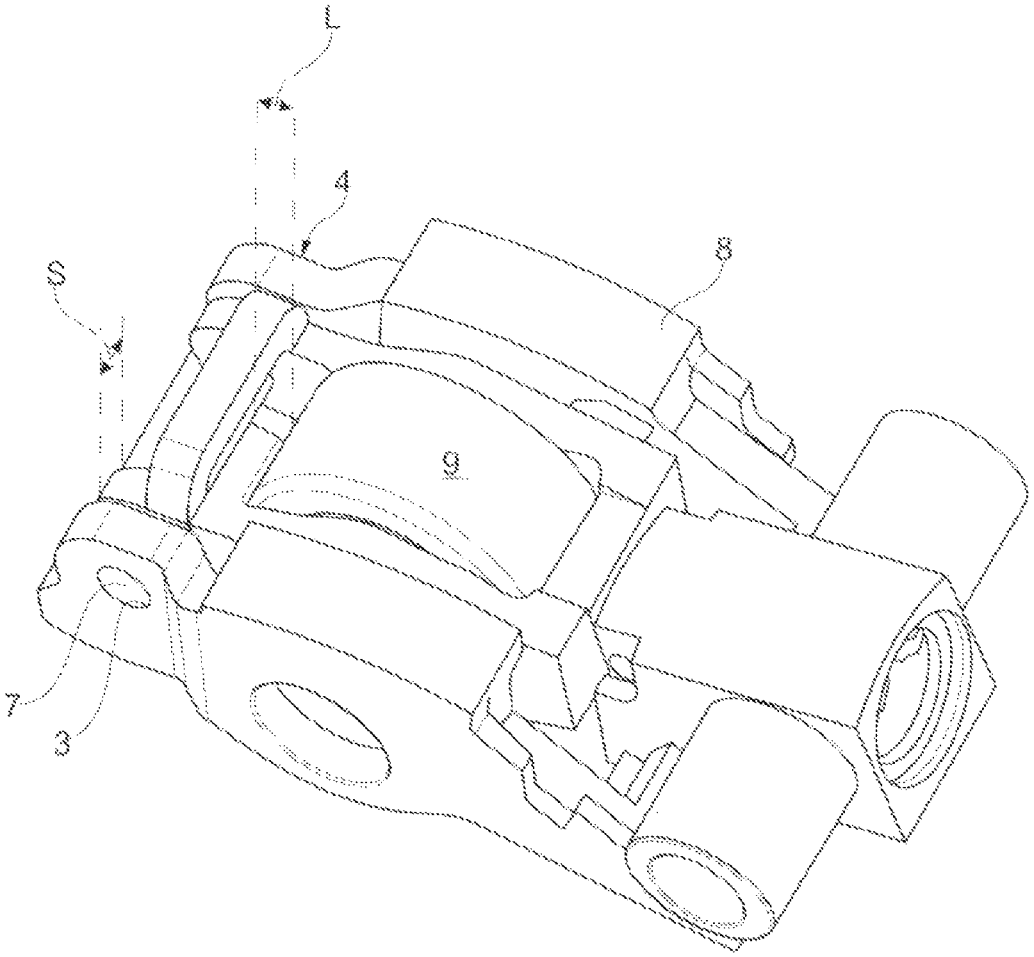

The internal lever arranged in FIG. 7 as an example in a switchable cam follower is supported with a pivoting motion on its support-side lever end area by a shaft 7 on an external lever 8 of the cam follower. Close to this, the stiffening element 5 is arranged parallel to the shaft 7 on the top side of the internal lever connected integrally to the side walls 1, 2. Here, the cam follower can be arranged with its top side, facing a not-shown driving camshaft, wherein a cam stroke movement can be tapped from the camshaft on a cam roller 9 arranged between the side walls 1, 2 of the internal lever and supported on these walls. Because, on the support-side lever end area of the internal lever, the side walls 1, 2 form a space for holding the cam roller 9 spaced apart opposite in the area of the openings 3, 4, this can be arranged as close as possible to the shaft 7 between the side walls 1, 2. In this way, the open distance L can be minimized between the outer diameter of the cam roller 9 and the shaft 7, wherein the longitudinal, axial installation space of the internal lever and the cam follower can be significantly reduced. Here, the distance L can be reduced to an amount less than or equal to twice the wall thickness S of the side walls 1, 2.

The external lever 8 is here constructed as a so-called primary lever that can be supported on a support-side lever end area with a pivoting motion on an adjacent component, in particular, a cylinder head of the internal combustion engine and can be arranged on a valve-side lever end area in contact with a not-shown gas exchange valve to be actuated. The internal lever can be coupled as a so-called secondary lever on the cross web of its coupling-side lever end area with the external lever 8 by a coupling mechanism integrated in this lever. In the decoupled state and for the transmission of a cam stroke movement by the cam roller, a lost stroke motion can be performed on the internal lever without valve actuation relative to the external lever 8.

The external lever 8 is formed of two parallel, opposing side walls that extend in the lever longitudinal direction and encompass, in the shown basic position of the internal lever not pivoted with respect to the external lever 8, its side walls 1, 2 on their outsides spaced apart slightly parallel. On the top side of the side wall of the external lever 9 there are sliding surfaces for following a cam stroke movement of the cam shaft. These are used for the stroke switching of the cam follower. The internal and external levers 8 are pretensioned by restoring springs, not shown, against each other in the basic position in which they can be coupled with each other by means of the coupling mechanism.

LIST OF REFERENCE SYMBOLS

1 Side wall
2 Side wall
3 Opening

4 Opening
5 Stiffening element
6 Welded joint
7 Shaft
8 External lever
9 Cam roller
B Width
D Distance
L Distance
S Wall thickness

The invention claimed is:

1. An internal lever for a switchable cam follower for a valve train of an internal combustion engine, the internal lever comprising two opposite side walls, between which at least one cam roller can be arranged for following a cam stroke motion, aligned opposing openings in the opposite side walls on a support-side lever end area adapted for receiving a shaft for pivoting support on an external lever of the cam follower encompassing the internal lever at least in some sections, the side walls being made from sheet metal and arranged spaced apart from each other in an area of the openings, forming a space that is adapted to receive the cam roller, and the side walls are connected to each other by an integral support wall and at least one stiffening element on the support-side lever end area on an opposite side from the integral support wall, the stiffening element being formed by two links that are each produced integrally with a respective one of the side walls, the two links and project upwardly from tops of the side walls, parallel to the support wall, and are formed inwardly in an arc shape from the side walls toward one another and rigidly connected to each other at free ends thereof.

2. The internal lever according to claim 1, wherein a distance (L) between a location of the shaft and an outer diameter of the cam roller is less than or equal to twice a wall thickness (S) of the side walls.

3. The internal lever according to claim 1, wherein the stiffening element is arranged outside of the space between the side walls and spans said space in a bow shape for connecting the side walls.

4. The internal lever according to claim 1, wherein the stiffening element is parallel to the shaft and is arranged at a height at or above a top of said shaft.

5. The internal lever according to claim 1, wherein a width (B) of the stiffening element is smaller than or equal to a wall thickness (S) of the side walls.

6. The internal lever according to claim 1, wherein the side walls and the stiffening element are stamped and bent.

7. The internal lever according to claim 1, wherein said cross web and side walls have a U-shaped profile in a top view, which has an open design in the support-side lever end area.

8. A method for producing an internal lever for a switchable cam follower for a valve train of an internal combustion engine, the internal lever comprising two opposite side walls, between which at least one cam roller is arrangeable for following a cam stroke motion, aligned opposing openings in the opposite side walls on a support-side lever end area adapted for receiving a shaft for pivoting support on an external lever of the cam follower encompassing the internal lever at least in some sections, the method comprising forming the side walls from sheet metal and arranging the side walls spaced apart from each other in an area of the openings, forming a space that is adapted to receive the cam roller, connecting the side walls to each other on the support-side lever end area using an integral support wall and at least one stiffening element on an opposite side from the integral support wall, producing the stiffening element from two links that extend integrally from respective ones of the side walls, said two links projecting upwardly from tops of the side walls, parallel to the support wall, and forming the two links inwardly in an arc shape from respective side walls toward one another and rigidly connecting the two links at free ends thereof to one another.

* * * * *